US006533708B2

(12) United States Patent
Taggett

(10) Patent No.: US 6,533,708 B2
(45) Date of Patent: Mar. 18, 2003

(54) EXERCISE APPARATUS

(76) Inventor: Michael Blake Taggett, 7810 E. Douglas Ave., Wichita, KS (US) 67206

( * ) Notice: Subject to any disclaimer, the term of this patent is extended or adjusted under 35 U.S.C. 154(b) by 0 days.

(21) Appl. No.: 09/848,835

(22) Filed: May 5, 2001

(65) Prior Publication Data

US 2001/0029222 A1 Oct. 11, 2001

Related U.S. Application Data

(63) Continuation of application No. 09/327,921, filed on Jun. 8, 1999.

(51) Int. Cl.[7] ..... A63B 69/16
(52) U.S. Cl. ..... 482/62; 482/51; 482/56
(58) Field of Search ..... 482/51, 55–57, 482/58, 59, 62, 63

(56) References Cited

U.S. PATENT DOCUMENTS

| | | | | |
|---|---|---|---|---|
| 326,247 A | * | 9/1885 | Root | 482/62 |
| 2,630,332 A | * | 3/1953 | Pettijohn | 280/233 |
| 3,017,180 A | * | 1/1962 | Aronsohn | 482/138 |
| 4,688,791 A | | 8/1987 | Long | |
| 4,880,225 A | | 11/1989 | Lukas et al. | |
| 4,902,002 A | | 2/1990 | Huang | |
| 4,934,690 A | | 6/1990 | Bull | |
| 4,948,119 A | * | 8/1990 | Robertson, Jr. | 272/71 |
| 5,040,785 A | | 8/1991 | Charnitski | |
| 5,378,209 A | | 1/1995 | Kendrew | |
| 5,492,518 A | | 2/1996 | Measom | |
| 5,575,739 A | | 11/1996 | Paiget et al. | |
| 5,584,782 A | | 12/1996 | Szabo et al. | |
| 5,616,106 A | | 4/1997 | Abelbeck | |
| 5,669,865 A | | 9/1997 | Gordon | |
| 5,709,633 A | | 1/1998 | Sokol | |
| 5,735,778 A | | 4/1998 | Piaget | |
| 5,816,983 A | | 10/1998 | Dawes et al. | |
| 5,836,859 A | | 11/1998 | Van Herle | |
| 5,906,563 A | | 5/1999 | Pittari | |
| 6,135,923 A | * | 10/2000 | Stearns et al. | 482/51 |

FOREIGN PATENT DOCUMENTS

| | | | | |
|---|---|---|---|---|
| CH | 613 120 A5 | * | 9/1979 | A63B/21/00 |
| CH | 613 120 | * | 9/1979 | A63B/21/00 |

* cited by examiner

*Primary Examiner*—Stephen R. Crow
*Assistant Examiner*—Tam Nguyen
(74) *Attorney, Agent, or Firm*—Robert Blinn

(57) ABSTRACT

The exercise apparatus of the present invention includes a base, a resistance device mounted to the base, a pair of foot pedal assemblies mounted to rotate in relation to the base, a pair of upright support assemblies mounted to the base and a pair of hand crank assemblies mounted to the upright support members. The resistance device includes a rotating element which turns when a torque is applied to it. The hand crank assemblies, the foot pedal assemblies and the rotating element of the resistance device are all operatively interconnected so that an operator can turn the rotating element of the resistance device by turning the foot pedal assemblies, by turning the hand crank assemblies or by turning both the foot pedal assemblies and the hand crank assemblies simultaneously at the same rate.

12 Claims, 5 Drawing Sheets

EXERCISE APPARATUS

CROSS REFERENCES TO RELATED APPLICATIONS

This application is a continuation-in-part of US Regular Utility patent application Ser. No. 09/327,921 filed Jun. 8, 1999.

FIELD OF THE INVENTION

This invention relates to an exercise apparatus and, more particularly, to an exercise apparatus for simultaneously exercising the arms and legs.

BACKGROUND OF THE INVENTION

In the last century, Americans have become much less active. Because of the introduction of the automobile and other modem conveniences, exercise and health experts now estimate that the daily physical effort exerted by adult Americans today is between 700 to 1,200 calories less than the physical effort exerted by adult Americans in 1900. With increasing rates of obesity, it is now becoming evident that this physical activity deficit is having a serious, negative impact on the health of many Americans. It is not surprising that in recent years, Americans have become increasingly aware of a need for exercise and that a large number of exercise machines have been introduced into the American market.

The patent literature discloses numerous exercise machines directed toward the simultaneous exercise of both the upper and lower body. For example, U.S. Pat. No. 4,880,225 by Lucas et al. discloses a stationary bicycle having reciprocating handles that are operatively interconnected with a pair of foot pedals and a resistance mechanism. U.S. Pat. Nos. 4,934,690 and 5,054,770 teach an apparatus having reciprocating hand and foot actuated levers. Robertson in U.S. Pat. No. 4,948,119 describes a swimming simulator that uses straps that retract into rotating spring biased reels that provide resistance to reciprocating hand and foot motions. Kendrew in U.S. Pat. No. 5,378,209 teaches an apparatus for simultaneous, vertical hand and foot motions that simulates mountain climbing.

Long in U.S. Pat. No. 4,688,791 teaches a swimming motion exerciser which employs hand cranks and foot pedals. The crank handles of Long's apparatus are mounted on either side of a single sprocket that is also operatively interconnected to a viscous resistance tank and a sprocket that carries a pair of foot pedals. Long's resistance tank includes paddles that rotate in a tank that contains a viscous fluid. Long's apparatus appears to provide a means to exercise both the arms and legs of an operator. However, the positioning of Long's crank handles are such that the operator can not position any part of his or her body between the handles. This prevents an operator from achieving a full range of arm motion. Moreover, the adjustment of Long's apparatus to accommodate different operator sizes appears to be very complex requiring a number of operations in order to maintain tension on drive chains that interconnect the crank handles and the foot pedals as the hand cranks and the foot pedals are adjusted in relation to each other.

While the foregoing exercise machines provide useful devices for exercising leg and arm muscles, there still exist a need for an exercise apparatus that provides a way to exercise the legs with a smooth rotary motion while also providing a way to exercise the arms with a smooth rotary motion of the hands over a large range of motion. Further, there exists a need for an exercise machine having spaced, arm exercising hand crank assemblies that are positioned upon a common axis of rotation so that an operator may position at least a portion of his or her upper body between the hand crank assemblies and even position a portion of his or her upper body in alignment with the common axis of rotation of the hand crank assemblies. Still further, there still exists a need for an exercise apparatus that can be easily adjusted to accommodate operators of varying stature.

SUMMARY OF THE INVENTION

The exercise apparatus of the present invention provides an easily adjustable means for exercising the arms over a large range of motion while also exercising the legs. The invention exercise machine has spaced, arm exercising hand crank assemblies that are positioned upon a common axis of rotation so that an operator may position at least a portion of his or her upper body between the hand crank assemblies and even position a portion of his or her upper body in alignment with the common axis of rotation of the hand crank assemblies. The invention exercise apparatus can be easily adjusted to accommodate operators of varying stature.

The invention apparatus includes a base, a resistance device mounted in a fixed relationship to the base, a pair of foot pedal assemblies mounted to rotate in relation to the base, a pair of upright support assemblies mounted to the base and a pair of hand crank assemblies mounted to the upright support assemblies. The resistance device includes a rotating element which turns when a torque is applied to it. The hand crank assemblies, the foot pedal assemblies and the rotating element of the resistance device are all operatively interconnected so that so that an operator can turn the rotating element of the resistance device by turning the foot pedal assemblies, by turning the hand crank assemblies or by turning both the foot pedal assemblies and the hand crank assemblies. The hand crank assemblies and the foot pedal assemblies are interconnected with each other and the rotating element of the resistance device so that the hand crank assemblies and the foot pedal assemblies turn in the same direction at the same rate. The upright support assemblies are fixed in relation to each other and are mounted to the base to pivot in relation to the base. The lengths of the upright support assemblies are also adjustable so that the hand crank assemblies can be raised and lowered together. Because the angle and length of the upright support assemblies can be adjusted, the position of the hand crank assemblies can be adjusted in relation to the foot pedal assemblies.

BRIEF DESCRIPTION OF THE DRAWINGS

The invention and its many attendant objects and advantages will become better understood upon reading the following description of the preferred embodiment in conjunction with the following drawings, wherein.

DETAILED DESCRIPTION OF THE INVENTION

Figure 1:
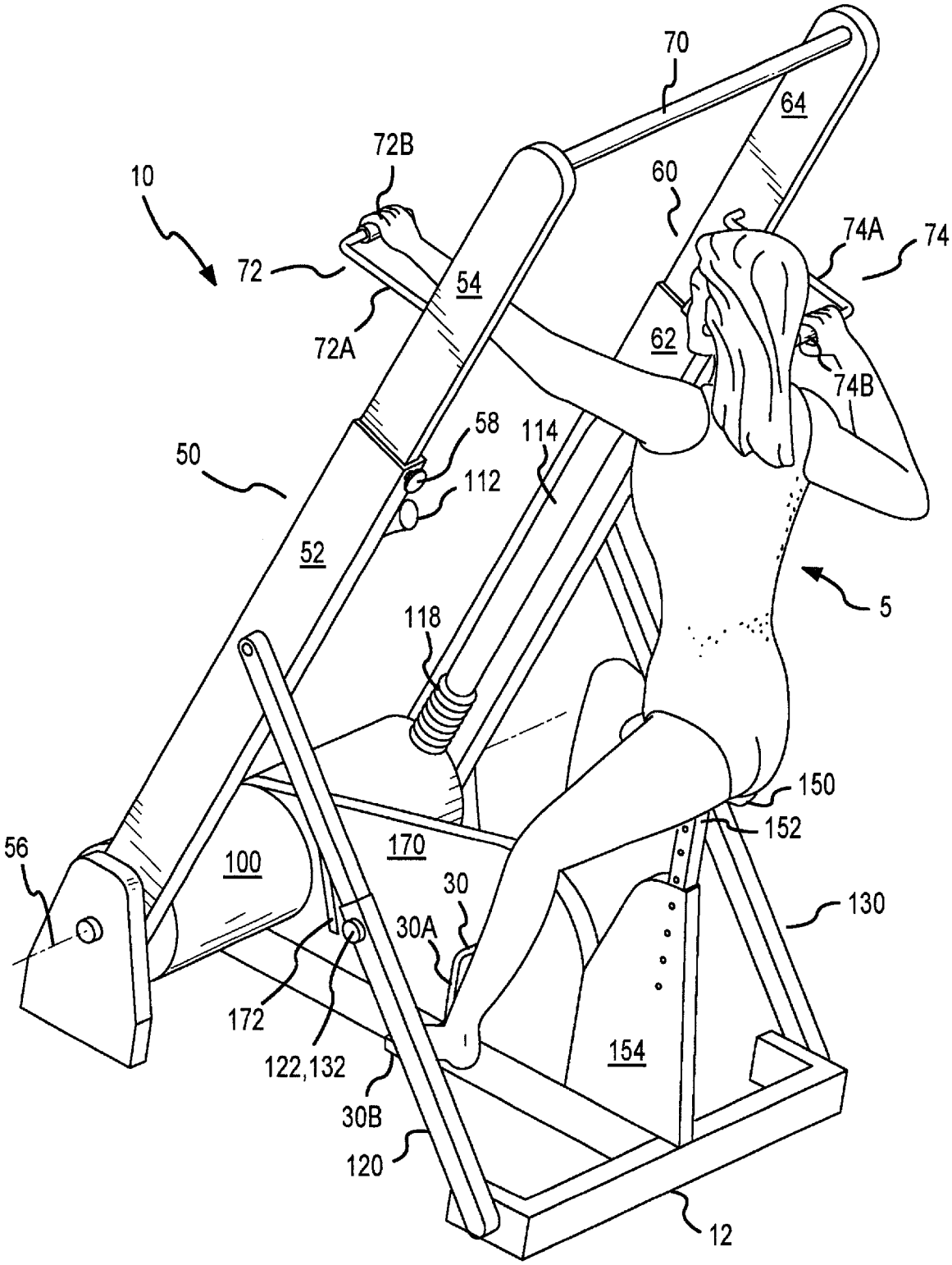
FIG. 1 is a perspective view of the exercise apparatus of the present invention shown with an operator.

Turning now to the drawings, wherein like reference numerals designate identical or corresponding parts, and more particularly to FIG. 1 thereof, an invention exercise apparatus 10 is shown with an operator 5 in a seated position. As can be seen in FIG. 1, exercise apparatus 10 includes a base 12, a pair of foot pedal assemblies 30 and 32, a pair of upright support assemblies 50 and 60, a pair of hand crank assemblies 72 and 74 mounted to the upright support assemblies 50 and 60 and a fan housing 100 that encloses a pair of cylindrical fans.

As can be seen in FIG. 1, upright support assemblies 50 and 60 are pivotably mounted to base 12 about axis 56 and are connected to each other at their upper ends by cross member 70. Upright support assembly 50 includes a lower portion 52 and an upper portion 54 that moves relative to lower portion 52 and that is locked in place with lock knob 58. Similarly, upright support assembly 60 includes a lower portion 62 and an upper portion 64 that moves relative to lower portion 62 and that is locked in place with lock knob 68 (shown in FIG. 2). Cross member 70 interconnects upper portion 54 of upright support assembly 50 to upper portion 64 of upright support assembly 60 so that both upper portions move together when adjusted for length. Telescoping adjustable struts 120 and 130 support upright support assemblies 50 and 60 and connect to base 12. Adjustable struts 120 and 130 are locked by lock knobs 122 and 132. Telescoping adjustable struts 120 and 130 are pivotably attached at their lower ends to base 12 and also pivotably attached at their upper ends to upright support assemblies 50 and 60. Upright support assemblies 50 and 60 can be adjustably rotated in unison about axis 56 as telescoping struts 120 and 130 are adjusted to accommodate their movement.

In FIG. 1, operator 5 is shown seated upon a seat 150. Seat 150 is supported by an adjustable seat post 152 which can be adjustably moved relative to seat post support 154. Although operator 5 is shown in FIG. 1 in a seated postion, operator 5 can also assume a standing position. Because the lengths and angle of upright support assemblies 50 and 60 can be adjusted as described above, it is possible to arrange pedal assemblies 30 and 32 and hand crank assemblies 72 and 74 within a large range of positions relative to each other. Hand crank assemblies 72 and 74 should be supported so that they rotate about a common axis and are separated by a distance at least as great as the shoulder width of operator 5.

Situated between seat post support 154 and fan housing 100 is a pedal sprocket housing 170. A series of intake vents 172 at the forward end of pedal sprocket housing 170 provide an air intake for the fans in fan housing 100. Mounted within sprocket housing 170 is a pedal sprocket which will be described in greater detail below. Mounted on each side of the pedal sprocket are foot pedal assemblies 30 and 32. Foot pedal assembly 30 is shown in FIG. 1 to include a pedal crank 30A which carries a pedal 30B.

Figure 2:
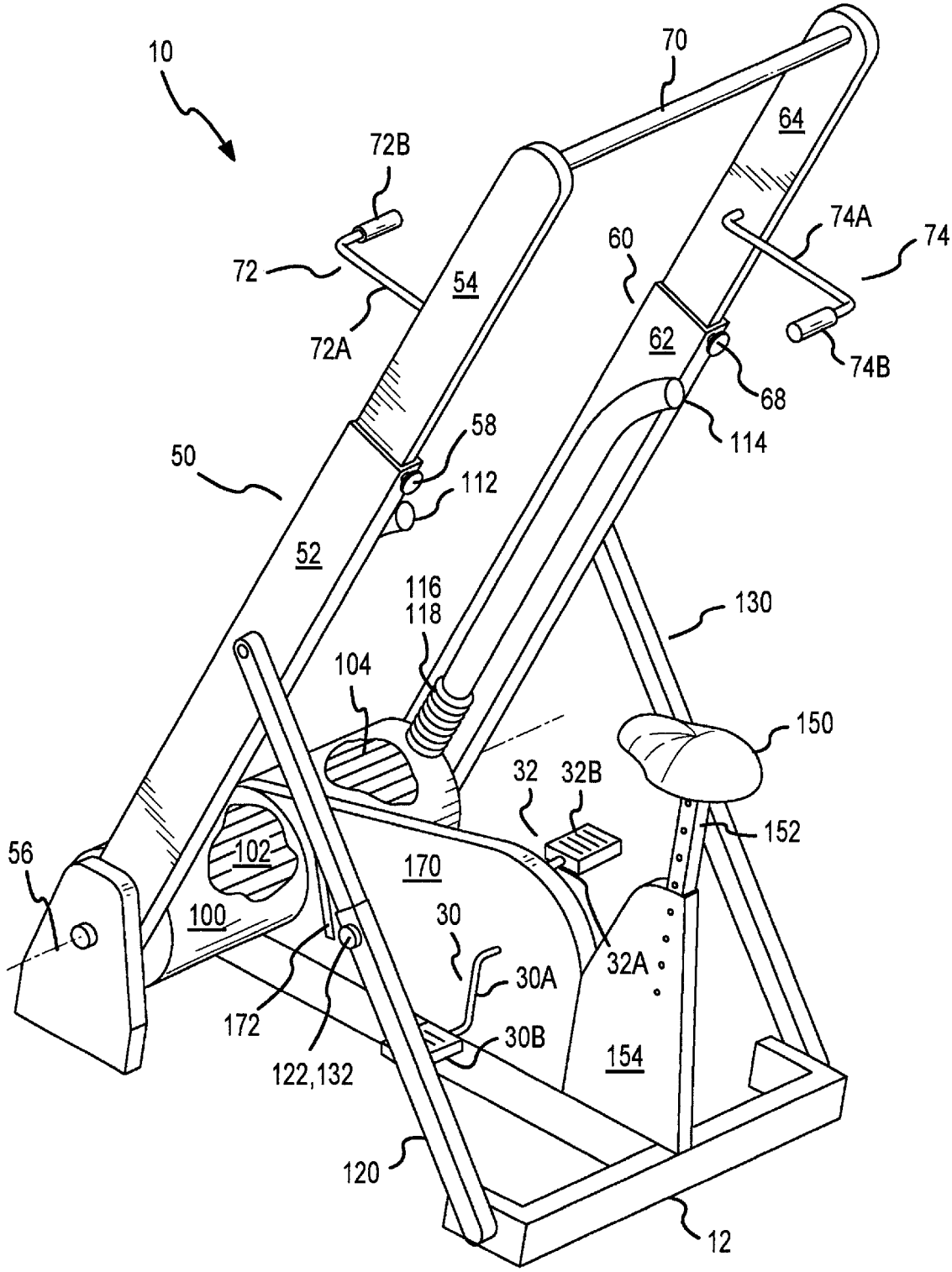
FIG. 2 is a perspective view of the exercise apparatus of the present invention shown without an operator.

FIG. 2 illustrates the invention exercise apparatus without an operator. FIG. 2 shows that resistance device 100 includes a pair of cylindrical fans 102 and 104 which turn on a central shaft that rotates about axis 56. Cylindrical fans 102 and 104 take in air from vents 172 and exhaust air through exhaust ducts 112 and 114. Exhaust ducts 112 and 114 can be provided with filters so that as the apparatus is operated, air can be filtered. Air vents 172 could be adapted to feed fan intake ducts (not shown) having means for adjusting the amount of air flow. As air flow is restricted, cylindrical fans 102 and 104 would turn more easily because less air would be accelerated in the fans. As more air flow is made available to cylindrical fans 102 and 104, a larger force would be required to turn the fans. Exhaust ducts 112 and 114 are fixed to lower portion 52 of upright support assembly 50 and lower portion 62 of upright support assembly 60 respectively and are provided with flexible joints 116 and 118 to allow rotating movement of upright support assemblies 50 and 60 relative to base 12.

Cylindrical fans 102 and 104 are rotating elements that provide resistance to turning motion and so basically they comprise a resistance device. Cylindrical fans are presently preferred because they are relatively easy to adapt for providing turning resistance without creating excessive waste heat or without adding a large amount of weight to the apparatus.

Numerous other rotating elements that resist turning could be selected other than cylindrical fans. For example, an electric generator could be selected. Simple friction devices such as belted flywheel could be employed. Preferably, the resisting element should provide smoothly increasing resistance with speed. A resistance device does not have to be mounted on base 12 at the lower end of upright support assemblies 50 and 60 as shown in FIG. 2. A resistance device need only be mounted somewhere on the apparatus in a fixed relationship to the apparatus.

As can be seen in FIG. 2, foot pedal assemblies 30 and 32 include pedal cranks 30A and 32A and pedals 30B and 32B. Pedals 30B and 32B are mounted on pedal cranks 30A and 32A so that they can rotate relative to each crank. Pedal cranks 30A and 32A are fixed 180° out of phase with each other to accommodate the reciprocating leg motion of the operator. Pedals 30B and 32B may include foot clamps (not shown) so that the operator may exert a force on pedals 30B and 32B during the entire revolution of foot pedal assemblies 30 and 32.

Hand cranks assemblies 72 and 74 include cranks 72A and 74A that are positioned to rotate about a common axis but are mounted separately to upright support assemblies 50 and 60. The common axis of rotation of hand crank assemblies 72 and 74 is parallel to the axis of rotation of foot pedal assemblies 30 and 32. Hand crank assemblies 72 and 74 include handles 72B and 74B that are mounted to their respective cranks so that they can rotate in relation to each of the cranks as the cranks rotate about their common axis. Preferably hand cranks assemblies 72 and 74 can be positioned so that they are 180° out of phase with each other and so that they are out of phase with pedal assemblies 30 and 32. Cross member 70 holds support assemblies 50 and 60 in relation to each other so that hand crank assemblies 72 and 74 maintain fixed relative positions. The mounting of handles 72B and 74B on their respective cranks could be adapted to allow adjustment of the handle position relative to the common axis of rotation of hand crank assemblies 72 and 74 so that the radius of motion of handles 72B and 74B may be increased or decreased to provide larger or smaller ranges of motion.

Figure 3:
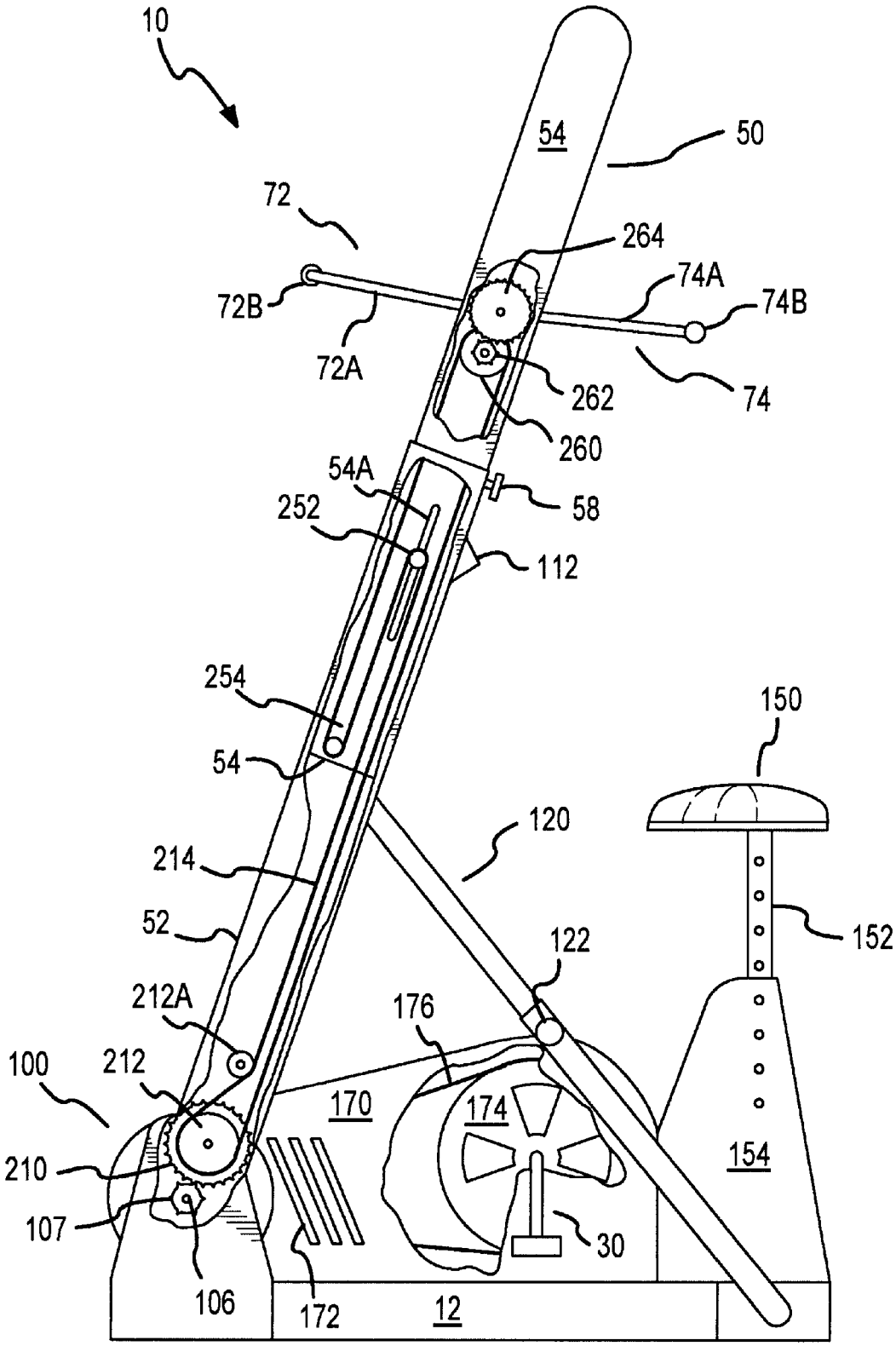
FIG. 3 is a cut away side view of the exercise apparatus of the present invention.

FIG. 3 is a cut away side view of apparatus 10. Sprocket housing 170, lower portion 52 and upper portion 54 of upright support assembly 50 have been cut away to expose the mechanisms for operatively interconnecting resistance device 100, hand crank assemblies 72 and 74 and foot pedal assemblies 30 and 32. FIG. 2 shows that resistance device 100 comprises a pair of fans 102 and 104. FIG. 3 shows a common shaft 106 upon which fans 102 and 104 are mounted.

Fans 102 and 104 shown in FIG. 2 and fan shaft 106 shown in FIG. 3 turn at a much higher speed than foot pedal assemblies 30 and 32. Sprocket housing 170 encloses a pedal sprocket 174 which is relatively large in diameter. A pedal drive chain 176 connects pedal sprocket 174 to a corresponding fan shaft sprocket (not shown) that is mounted near the center of fan shaft 106. The fan drive sprocket has a much smaller diameter than pedal sprocket 174. The smaller fan drive sprocket on fan shaft 106 and pedal sprocket 174 are preferably sized so that fan shaft 106 turns ten or twenty times when pedal sprocket 174 is turned once. Other resistance devices could be selected that turn at much slower speeds and therefore would require much lower gear ratios than 10:1 to 20:1.

In FIG. 3, lower portion 52 and the upper portion 54 of upright support assembly 50 have been cut away to expose the mechanical components that interconnect hand crank assembly 72 with fan shaft 106. The skilled reader should understand that identical, opposite components are also present in upright support assembly 60. Fan shaft 106 carries at its end a fan drive gear 107 which meshes with a first handle drive gear 210. The gear ratio between fan drive gear 107 and first handle drive gear 210 is at least a significant portion of the gear ratio between pedal sprocket 174 and the fan shaft drive sprocket (not shown). Mounted concentrically with and fixed to handle drive gear 210 is a first handle drive sprocket 212. First handle drive sprocket 212 carries a handle drive chain 214 that interconnects with a second handle drive sprocket 260. An idler sprocket 212A, mounted to lower portion 52, guides the left leg of hand crank drive chain 214 closer to its right leg.

The left leg of hand crank drive chain 214 is reticulated around an upper adjustment sprocket 252 and a lower adjustment sprocket 254 to allow upper portion 54 and lower portion 52 of upright support assembly 50 to move in relation to each other. Lower adjustment sprocket 254 is mounted to upper portion 54 of upright support assembly 50, while upper adjustment sprocket 252 is mounted to lower portion 52 of upright support assembly 50. A slot 54A in upper portion 54 allows the shaft that carries upper adjustment sprocket 252 to move relative to upper portion 54. Since lower adjustment sprocket 254 can be mounted directly to the smaller upper portion 54, no such slot is needed for lower adjustment sprocket 254. Either lower adjustment sprocket 254 or upper adjustment sprocket 252 can be mounted with a spring bias to pull away from the other adjustment sprocket to maintain tension in hand crank chain 214. As upper portion 54 is moved out and away from lower portion 52, the distance spanned by hand crank drive chain 214 would increase. However, as upper portion 54 is moved out and away from lower portion 52, the distance between upper adjustment sprocket 252 and lower adjustment sprocket 254 decreases by the same distance thereby compensating for any adjustment in the length of upright support assembly 50.

The left leg of hand crank drive chain 214 circles around a second handle drive sprocket 260 and then back down to the bottom of upright support assembly 50 to first handle drive sprocket 212. Second handle drive sprocket 260 carries a second handle drive gear 262 which turns a third handle drive gear 264. The net effect of this arrangement is that hand crank assembly 72 rotates in the same direction but at a much slower speed as fan shaft 106. Given the reduction of speed between fan shaft 106 and pedal sprocket 174, the net effect of this arrangement is also that hand crank assemblies 72 and 74 turn in the same direction and at the same rate of rotation as foot pedal assemblies 30 and 32.

Hand crank assemblies 72 and 74 as well as foot pedal assemblies 30 and 32 can be clutched to the drive train by Sprague clutches that only allow one way rotation. With Sprague clutches, hand crank assemblies 72 and 74 can be held stationary while foot pedal assemblies 30 and 32 are powered. In the same way, foot pedal assemblies 30 and 32 can be held stationary while hand crank assemblies 72 and 74 are powered.

Second Embodiment

Figure 4:
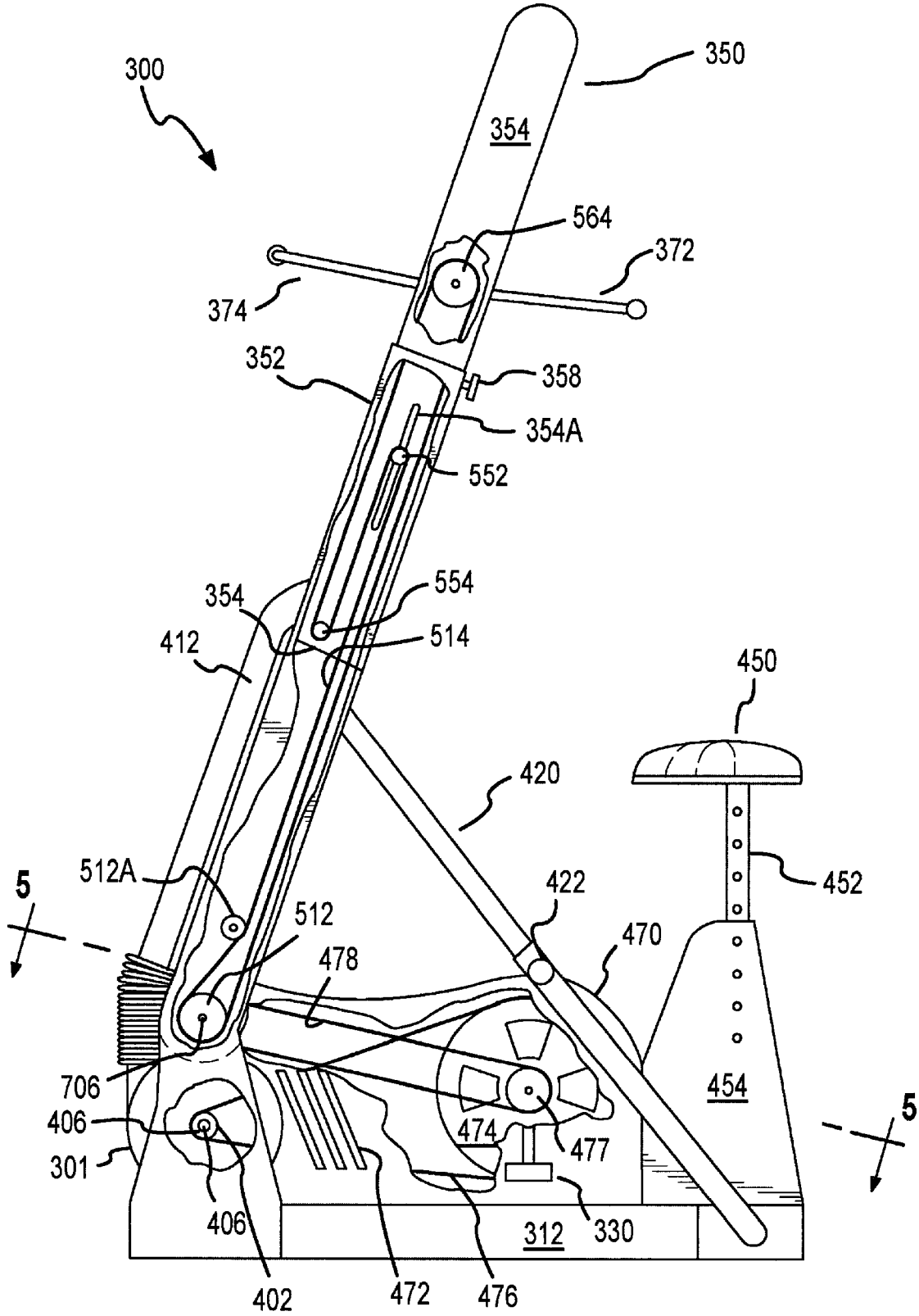
FIG. 4 is a cut away side view of a second embodiment of the exercise apparatus of the present invention.

FIG. 4 illustrates a second embodiment of the invention exercise apparatus designated as exercise apparatus 300. FIG. 4 is a side view and it should be understood that all the structures associated with upright support assembly 350 are repeated in a second upright support assembly 360 that is not shown in FIG. 4. Apparatus 300 includes an upright support assembly that pivots about a power transfer shaft 706. Power transfer shaft 706 is a second shaft that is mounted parallel to and above fan shaft 406. Power transfer shaft 706 basically acts as part of a mechanical linkage between the hand crank assemblies and the foot pedal assemblies of apparatus 300. With apparatus 300, power is transferred from foot pedal assemblies (which are also interconnected with the hand crank assemblies) to a separate fan shaft 406 via a fan drive chain 476. Because of this placement of the fan drive train outside of the hand crank and foot pedal drive train, fan shaft 406 can turn at a much different rate than the hand crank assemblies and the foot pedal assemblies and the rate of rotation of fan drive shaft 406 can be changed without changing the speed of rotation of the hand crank and foot pedal drive train.

Figure 5:
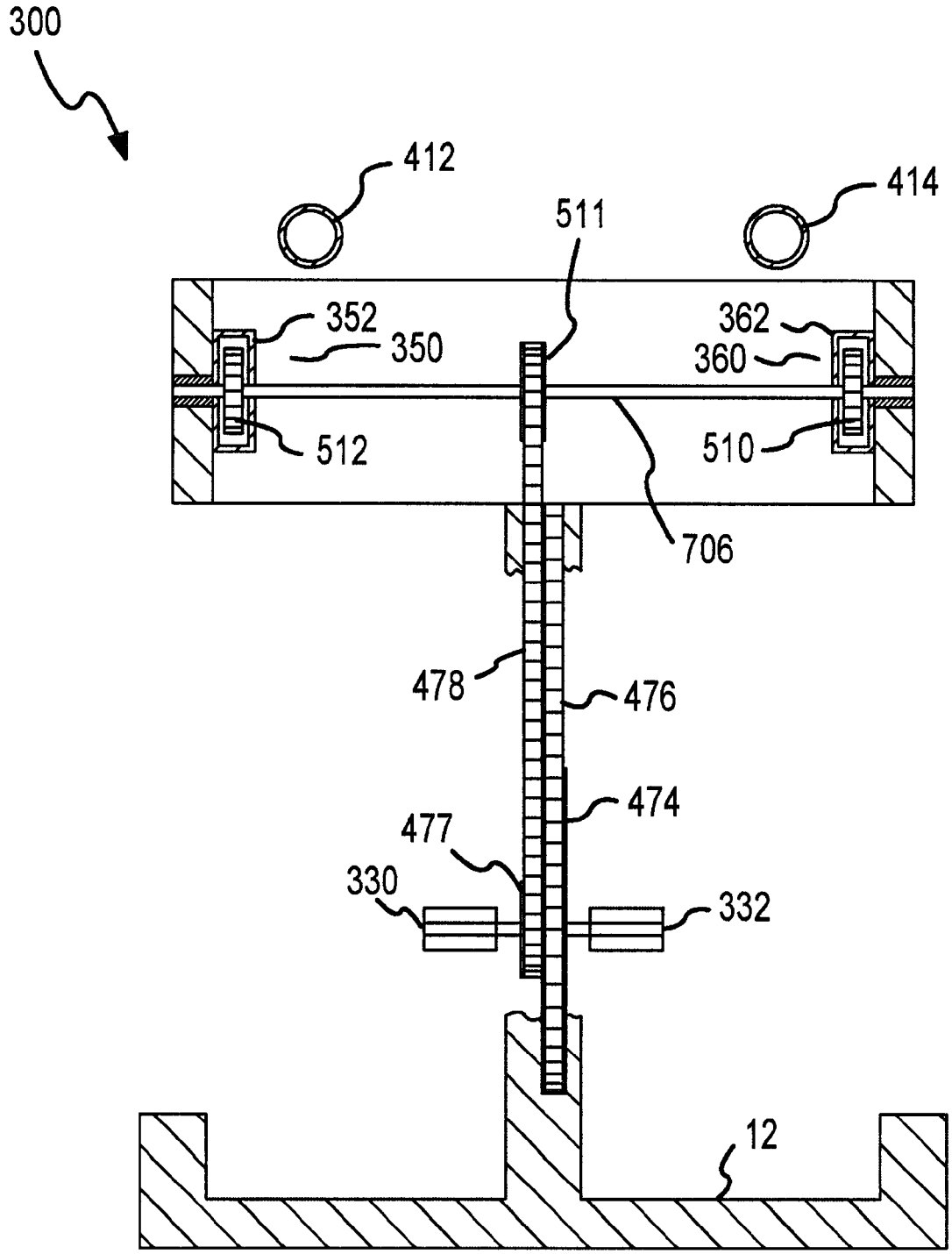
FIG. 5 is a cut away view of the second embodiment of the exercise apparatus of the present invention taken from plane 5—5 of FIG. 4.

FIG. 5 is a sectional view taken from plane 5—5 of FIG. 4. FIG. 5 shows the arrangement of four of the six sprockets that are associated with the rotation of foot pedal assemblies 330 and 332 as well as power transfer shaft 706. As can be seen in FIG. 4 and FIG. 5, as second pedal sprocket 477 is mounted to first pedal sprocket 474. Second pedal sprocket 477 is shown to be substantially smaller than first pedal sprocket 474. As can be seen in FIG. 5, a drive chain 478 transfers power from second pedal sprocket 477 to a center transfer sprocket 511 which is fixed to the center of power transfer shaft 706. As power transfer shaft 706 rotates, right sprocket 510 and left sprocket 512 also rotate. Second pedal sprocket 477 and center transfer sprocket 511 have the same diameter so that second pedal sprocket 477 and power transfer shaft 706 rotate at the same rate.

As can be seen in FIG. 4, left transfer sprocket 512 is situated in the lower end of lower portion 352 of upright support assembly 350. In the same way right transfer sprocket 510 is located in the lower end of lower portion 362 of upright support assembly 360. As can be seen in FIG. 4, fan drive chain 476 transfers power between the large first pedal sprocket 474 and the a fan power transfer sprocket 402 mounted at the center of fan shaft 706. First pedal sprocket 474 could be replace by a series of concentric sprockets having different diameters as is used in a multi-speed bicycle. In this way the gear ratio between first pedal sprocket 474 and fan power transfer sprocket 402 can be adjusted.

FIG. 4 provides a cut away view of upright support assembly 350 as well as portions of the housing between foot pedal assembly 330 and upright support assembly 350. Left power transfer sprocket 512 is shown in FIG. 4 to be interconnected by a crank drive chain 514 to a crank drive sprocket 564 mounted in upper portion 354 of upright support assembly 350. As with the arrangement of exercise apparatus 10 shown in FIG. 3, crank drive chain 514 is folded in a serpentine path around an upper adjustment sprocket 552 and a lower adjustment sprocket 554. As with exercise apparatus 10, upper adjustment sprocket 552 is mounted to the upper end of lower portion 352 of upright support assembly 350 and is provided with a slot 354A in upper portion 354 to allow movement of its shaft relative to upper portion 354 while lower adjustment sprocket 554 is mounted to the lower end of upper portion 354. As with exercise apparatus 10, when upper portion 354 is moved with respect to lower portion 352, upper adjustment sprocket 552 moves in an opposite manner in relation to lower adjustment sprocket 554 to compensate for the change in distance between left power transfer sprocket 512 and crank drive sprocket 564. It is important that left power transfer sprocket and crank drive sprocket 564 have the same diameter so that hand crank assembly 372 rotates at the same speed as power transfer shaft 706. In the alternative, the arrangement of sizes of second pedal sprocket 477, center transfer sprocket 511, right sprocket 510, left sprocket 512 and the crank drive sprockets that turn each of the hand crank assemblies 372 and 374 should be such that foot pedal assemblies 330 and 332 rotate at the same speed as crank handle assemblies 372 and 374.

Upright support assemblies 350 and 360 of exercise apparatus 300 can be adjustably rotated about power transfer shaft 706 as adjustable support strut 420 and a corresponding opposite support strut (not shown) is shortened or lengthened. By combining this angular adjustment with the adjustment of upright support members 350 and 360 it is possible with apparatus 300, as with apparatus 10, to position hand crank assemblies 372 and 374 within a wide range of locations in relation to foot pedal assemblies 330 and 332.

As can be seen in FIG. 4, a pair of fan exhaust ducts 412 and 414 are located at the forward side of fan housing 301 to clear power transfer shaft 706. Exhaust ducts 412 and 414 include flexible portions and are mounted to of upright support members 350 and 360. Exhaust ducts 412 and 414 can contain filtration devices for filtering and purifying air as it is forced through the ducts. Intake vents 472 are also located in the side of pedal sprocket housing 470. Intake vents 472 can be arranged to feed adjustable air ducts that feed the intake portions of the fans in fan housing 301. As with apparatus 10, the adjustable air ducts can be used to adjust the amount of intake air and thereby adjust the amount of force needed to turn the fans in fan housing 301.

Hand crank assemblies 372 and 374 as well as foot pedal assemblies 330 and 332 can be clutched to the drive train by Sprague clutches that only allow one way rotation. With Sprague clutches, hand crank assemblies 372 and 374 can be held stationary while foot pedal assemblies 330 and 332 are powered. In the same way, foot pedal assemblies 330 and 332 can be held stationary while hand crank assemblies 372 and 374 are powered.

Exercise apparatus 300 employs a different arrangement for interconnecting foot pedal assemblies, hand crank assemblies and a rotating resistance device such as a pair of cylindrical fans than that used by exercise apparatus 10. Any one of many power transferring arrangements known in the art can be used to maintain synchronous motion between foot pedal assemblies and hand crank assemblies. One way Sprague clutches may be employed with both the foot pedal assemblies and hand crank assemblies to insure safety. With Sprague clutches, the operator will intuitively pause either the foot pedal assemblies or the hand crank assemblies until the proper out of phase positions are obtained. It is important that the hand crank assemblies are interconnected by a power train to turn in unison. If the handles of the hand crank assemblies were adjustably attached to their cranks to slide and lock in relation to their cranks, it would be possible to adjust the radius of motion of the hand crank assemblies. Further, the cranks of the hand crank assemblies could be adjustable so that they could also be locked to turn in an in-phase relationship with each other to exercise upper body muscles in a different manner.

As power is transferred from the operator to a rotating resistance device, it should be possible to measure the transfer of energy between the operator and the resistance device by continuously measuring the torque applied to shaft that turns the rotating resistance device. This would be accomplished with a simple force transducer arrangement. With this measurement it should be possible to determine the operator's power output. Using devices and methods well known in the art, the total energy output occurring during an exercise session can be accurately determined. This energy output measurement would be much more accurate than the calorie estimates provided by treadmills.

Preferably, the rotating resistance device should be adapted to increase resistance with speed. Cylindrical fans are appropriate for this application because as a cylindrical fan is turned at a higher speed it offers more resistance. The relationship of resistance to speed should roughly correspond to the wind resistance encountered by a cyclist as a bicycle is operated at increasing speeds. With second embodiment exercise apparatus 300 shown in FIG. 4 and FIG. 5, it should be possible to adjust the gear ratio between the first pedal sprocket 474 and power transfer sprocket 402 that drives fan shaft 406. With such a gear ratio adjustment, either a high speed, low resistance exercise session or a low speed, high resistance exercise session would be possible.

As can be seen from the forgoing description, the invention exercise apparatus provides a means for simultaneously exercising a very large proportion of the major muscle groups. Because the hand crank assemblies of the invention exercise apparatus are separately mounted on upright support assemblies, they can be spaced to either side of an operator's upper body and can describe large circular paths that allow the operator to position part of his or her upper body between the hand crank assemblies and move his or her hands through a large range of motion. It is this large range of motion that allows the operator to completely exercise extensive muscle groups throughout the body. With the present invention exercise apparatus it is even possible for the operator to position a portion his or her upper body between the hand crank assemblies and in alignment with the axis of rotation of the hand crank assemblies allowing an even greater range of motion. This makes it possible for the operator to fully exercise the muscle groups of the upper body while also fully exercising lower body muscle groups. This full body exercise capability provides an efficient means for concentrating a relatively large amount of exercise effort within a relatively short period of time. Because the upright support assemblies of the invention exercise apparatus can be easily pivoted and adjusted in length, the hand crank assemblies can be located relative to foot pedal assemblies in a wide range of relative positions to accommodate the preferences of an operator or to accommodate operators of varying statures. The resulting effect of all of the features of the invention apparatus is an apparatus that can provide an extremely broad range of exercise options to an operator in terms of position, range of motion and intensity.

Obviously, in view of the embodiments described above, numerous modifications and variations of the preferred embodiments disclosed herein are possible and will occur to those skilled in the art in view of this description. For example, many functions and advantages are described for the preferred embodiments, but in some uses of the invention, not all of these functions and advantages would be needed. Therefore, I contemplate the use of the invention using fewer than the complete set of noted functions and advantages. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly to be understood that these modifications and variations, and the equivalents thereof, are to be considered within the spirit and scope of the invention as defined by the following claims, wherein, I claim:

1. An exercise apparatus for exercising the muscles associated with moving the legs and the arms of an operator, comprising:

(a) a base, (a) a resistance device mounted to the base that includes a rotating element that turns when torque is applied thereto, (c) a pair of foot pedal assemblies mounted to the base to rotate in relation to the base, (d) a first upright support assembly and a second upright support assembly mounted to the base in a parallel, spaced relationship to each other for carrying rotatably mounted first and second hand crank assemblies, the first and second upright support assemblies having lower portions mounted to the base and upper portions for carrying the hand crank assemblies, the upper portions telescopically mounted to the lower portions for adjustable extending and retracting movement so that the elevation of the hand crank assemblies may be adjusted, (e) the foot pedal assemblies, the hand crank assemblies and the rotating element of the resistance device operatively interconnected by a drive mechanism sufficiently adjustable to allow the telescoping movement of the upper portions of the upright assemblies, the drive mechanism configured such that the foot pedal assemblies and the hand crank assemblies turn in the same direction at substantially the same rate and so that the operator can turn the rotating element of the resistance device by turning the foot pedal assemblies, by turning the hand crank assemblies or by turning both the foot pedal assemblies and the hand crank assemblies, whereby the muscles of the operator associated with movement of the legs and arms of the operator may be exercised simultaneously or separately.

2. The exercise apparatus of claim five wherein:

the first and second upright support assemblies are mounted to the base to adjustably rotate in relation to the base.

3. An exercise apparatus for exercising the muscles associated with moving the legs and the arms of an operator, comprising:

(a) a base, (b) a fan that is adjustable so that the amount of air moved by the fan can be adjusted, the fan turning when torque is applied thereto, (c) a pair of foot pedal assemblies, the foot pedal assemblies fixed to a foot pedal sprocket that is mounted to the base to rotate in relation to the base, (d) a first upright support assembly and a second upright support assembly mounted to the base in a parallel, spaced relationship to each other for carrying rotatably mounted first and second hand crank assemblies, the first and second upright support assemblies having lower portions mounted to the base and upper portions for carrying the hand crank assemblies, the upper portions telescopically mounted to the lower portions for adjustable extending and retracting movement so that the elevation of the hand crank assemblies may be adjusted, (e) the foot pedal sprocket, the hand crank assemblies and the fan operatively interconnected by a drive mechanism sufficiently adjustable to allow the telescoping movement of the upper portions of the upright assemblies, the drive mechanism configured such that the foot pedal sprocket and the hand crank assemblies turn in the same direction at substantially the same rate and so that the operator can turn the fan by turning the foot pedal assemblies, by turning the hand crank assemblies or by turning both the foot pedal assemblies and the hand crank assemblies, whereby muscles associated with movement of the legs and arms may be simultaneously exercised.

4. The exercise apparatus of claim 3 wherein:

the first and second upright support assemblies are mounted to the base to adjustably rotate in relation to the base.

5. An exercise apparatus for exercising the muscles associated with moving the legs and the arms of an operator, comprising:

(a) a base, (b) a resistance device mounted to the base that includes a rotating element that turns when torque is applied thereto, (c) a pair of foot pedal assemblies mounted to a foot pedal sprocket, the foot pedal sprocket mounted to the base to rotate in relation to the base, (d) a first upright support assembly and a second upright support assembly mounted to the base in a parallel, spaced relationship to each other for carrying rotatably mounted first and second hand crank assemblies, the upright support assemblies mounted to the base to adjustably rotate in relation to the base, the first and second upright support assemblies having lower portions mounted to the base and upper portions for carrying the hand crank assemblies, the upper portions telescopically mounted to the lower portions for adjustable extending and retracting movement so that the elevation of the hand crank assemblies may be adjusted, (e) the foot pedal sprocket, the hand crank assemblies and the rotating element of the resistance device operatively interconnected by a drive mechanism sufficiently adjustable to allow the telescoping movement of the upper portions of the upright assemblies, the drive mechanism configured such that the foot pedal sprocket and the hand crank assemblies turn in the same direction at substantially the same rate and so that the operator can turn the rotating element of the resistance device by turning the foot pedal assemblies, by turning the hand crank assemblies or by turning both the foot pedal assemblies and the hand crank assemblies, whereby the muscles of the operator associated with movement of the legs and arms of the operator may be exercised simultaneously or separately.

6. An exercise apparatus for exercising the muscles associated with moving the legs and the arms of an operator, comprising:

(a) a base, (b) a resistance device mounted to the base that includes a rotating element that turns when torque is applied thereto, (c) a pair of foot pedal assemblies, the foot pedal assemblies fixed to a foot pedal sprocket that is mounted to the base to rotate in relation to the base, (d) a first upright support assembly and a second upright support assembly mounted to the base in a parallel, spaced relationship to each other, (e) first and second hand crank assemblies respectively rotatably mounted opposite one another to the first and second upright support assemblies, (f) the hand crank assemblies each mechanically linked in a handle drive train including at least a handle sprocket, a lower chain drive sprocket and a handle drive chain linking the handle sprocket and the lower chain drive sprocket, the handle sprockets turning when the hand crank assemblies turn, the lower chain drive sprockets mounted to a common shaft that is mechanically linked to the foot pedal sprocket to rotate when the foot pedal sprocket rotates so that the foot pedal assemblies and the hand crank assemblies turn in the same direction at substantially the same rate, (g) the foot pedal sprocket and the hand crank assemblies also operatively interconnected with the rotating element of the resistance device so that the operator can turn the rotating element of the resistance device by turning the foot pedal assemblies by turning the hand crank assemblies or by turning both the foot pedal assemblies and the hand crank assemblies, whereby the muscles of the operator associated with movement of the legs and arms of the operator may be exercised simultaneously or separately, and, (h) the first and second upright support assemblies including lower portions mounted to the base and upper portions for carrying the hand crank assemblies, the upper portions slidably mounted to the lower portions to extend and retract telescopically in relation to the lower portions to adjust the elevation of the hand crank assemblies, each handle drive chain within the first and second upright support assemblies following a folded path around an upper adjustment sprocket and a lower adjustment sprocket which are mounted to the upper and lower portions such that the upper and lower adjustment sprockets move away from each other when the upper portion is retracted relative to the lower portion and such that the upper and lower adjustment sprockets move toward each other when the upper portion is extended relative to the lower portion to maintain substantially constant tension in the handle drive chain as the elevation of the hand crank assemblies is adjusted.

7. The exercise apparatus of claim 6 wherein:

the resistance device is at least one cylindrical fan.

8. The exercise apparatus of claim 6 wherein:

the resistance device is at least one cylindrical fan supplied by at least one intake duct that can be adjusted to change the amount of air supplied to the fan.

9. The exercise apparatus of claim 6 wherein:

the foot pedal sprocket and the hand crank assemblies are operatively interconnected with the rotating element of the resistance device with more than one gear ratio so that the resistance device may be turned at more than one speed relative to the foot pedal assemblies and the hand crank assemblies.

10. The exercise apparatus of claim 6 wherein, the first and second upright support assemblies are pivotably mounted to the base so that they can be pivotably adjusted in relation to the base in various fixed positions.

11. The exercise apparatus of claim 6 wherein, the upper adjustment sprocket is attached toward the upper end of the lower portion and the lower adjustment sprocket is attached to the lower end of the upper portion and positioned below the upper adjustment sprocket, such that the upper and lower adjustment sprockets move away from each other when the upper portion is retracted relative to the lower portion and such that the upper and lower adjustment sprockets move toward each other when the upper portion is extended relative to the lower portion to maintain substantially constant tension in the handle drive chains as the elevation of the hand crank assemblies is adjusted.

12. The exercise apparatus of claim 6 wherein, the first and second upright support assemblies are pivotably mounted to the base so that they can be pivotably adjusted in relation to the base in various fixed positions, and wherein, the upper adjustment sprocket is attached toward the upper end of the lower portion and the lower adjustment sprocket is attached to the lower end of the upper portion and positioned below the upper adjustment sprocket, such that the upper and lower adjustment sprockets move away from each other when the upper portion is retracted relative to the lower portion and such that the upper and lower adjustment sprockets move toward each other when the upper portion is extended relative to the lower portion to maintain substantially constant tension in the handle drive chains as the elevation of the hand crank assemblies is adjusted.

* * * * *